US006448875B1

(12) United States Patent
Sciarrino

(10) Patent No.: US 6,448,875 B1
(45) Date of Patent: Sep. 10, 2002

(54) WAVEGUIDE INTERCONNECTION SYSTEM

(76) Inventor: Matthew J. Sciarrino, 11655 - 54th St. North, Clearwater, FL (US) 33760

( * ) Notice: Subject to any disclaimer, the term of this patent is extended or adjusted under 35 U.S.C. 154(b) by 0 days.

(21) Appl. No.: 09/801,206

(22) Filed: Mar. 7, 2001

(51) Int. Cl.[7] ..... H01P 1/04; H01P 3/12
(52) U.S. Cl. ..... 333/254; 333/248
(58) Field of Search ..... 333/254, 248, 333/255, 256

(56) References Cited

U.S. PATENT DOCUMENTS 3,189,854 A * 6/1965 Bubbard ..... 333/255

FOREIGN PATENT DOCUMENTS

GB 2170055 * 7/1986 ..... H01P/1/04

* cited by examiner

*Primary Examiner*—Robert Pascal
*Assistant Examiner*—Joseph Chang

(57) ABSTRACT

An interconnection system for effecting the rapid connection and disconnection of facing components comprises male and female connectors. A first end of the male connector is generally rectangular. The second end has a cylindrical portion extending inwardly, an inner face, and radially extending flanges. Recesses are formed between the flanges and the first end. The female connector is configured to mate with the male. When in the locked state the flanges of the male connector form a coplanar coupling with receivers of the female connector.

3 Claims, 3 Drawing Sheets

FIG 1
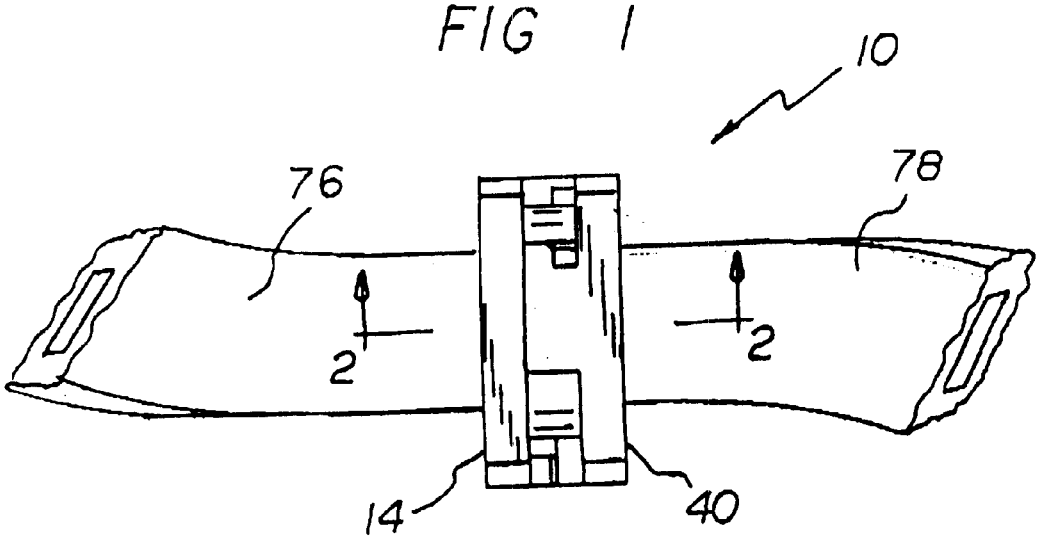
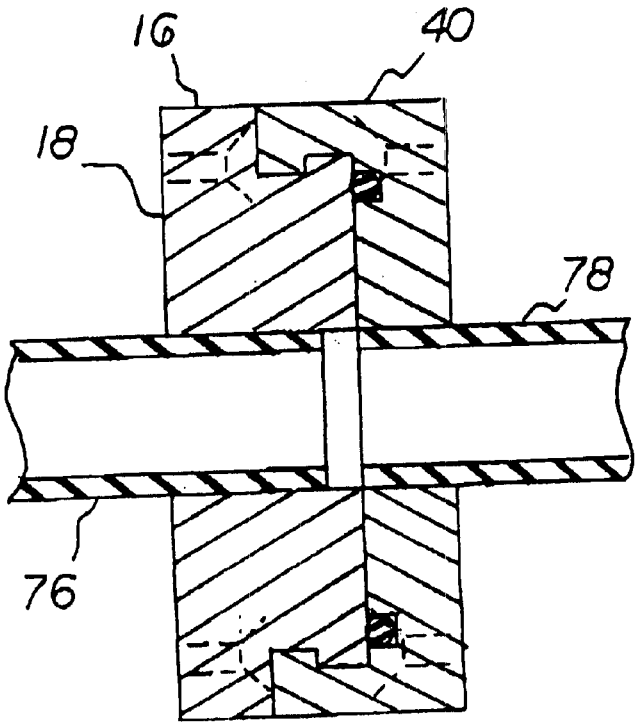
FIG 2

FIG 3
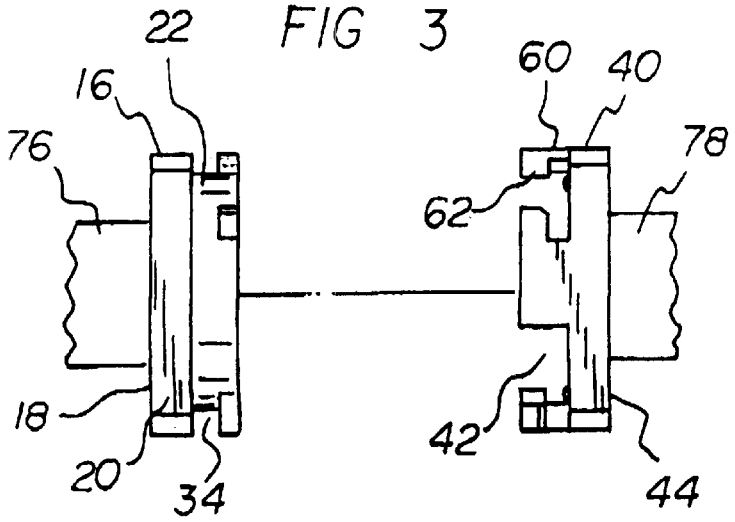
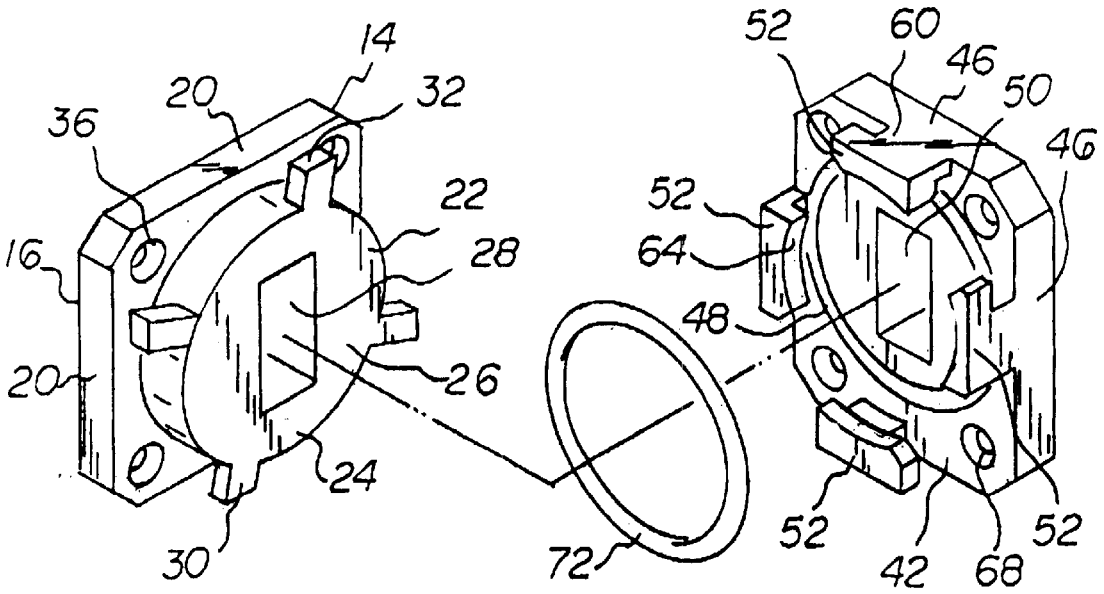
FIG 4

WAVEGUIDE INTERCONNECTION SYSTEM

BACKGROUND OF THE INVENTION

1. Field of the Invention

The present invention relates to a waveguide interconnection system for effecting the rapid connection and disconnection of facing components.

2. Description of the Prior Art

The use of connection systems of known designs and configurations is known in the prior art. More specifically, connection systems of known designs and configurations previously devised and utilized for the purpose of connecting and disconnecting components through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 3,605,041 to Judkins, et al discloses a permanent waveguide connection for occasional use. U.S. Pat. No. 4,011,532 to Williams et al discloses a fast acting waveguide coupler. U.S. Pat. No. 5,364,136 to Forti et al discloses flanges and bodies for microwave waveguides components. Lastly, U.S. Pat. No. 6,140,893 to Sciarrino discloses a waveguide interconnection system.

While these devices fulfill their respective, particular objectives and requirements, the aforementioned patents do not describe a waveguide interconnection system that allows for effecting the rapid connection and disconnection of facing components.

In this respect, the waveguide interconnection system according to the present invention substantially departs from the conventional concepts and designs of the prior art, and in doing so provides an apparatus primarily developed for the purpose of effecting the rapid connection and disconnection of facing components.

Therefore, it can be appreciated that there exists a continuing need for a new and improved waveguide interconnection system which can be used for effecting the rapid connection and disconnection of facing components. In this regard, the present invention substantially fulfills this need.

SUMMARY OF THE INVENTION

In view of the Foregoing disadvantages inherent in connection systems of known designs and configurations now present in the prior art, the present invention provides an improved waveguide interconnection system. As such, the general purpose of the present invention, which will be described subsequently in greater detail, is to provide a new and improved waveguide interconnection system which has all the advantages of the prior art and none of the disadvantages.

To attain this, the present invention essentially comprises a male connector. The male connector has a first end of a generally rectangular configuration. The first end has an outer face and a plurality of side faces. The male connector also has a second end. The second end comprises a cylindrical portion extending inwardly with respect to the system. The second end has an inner face. The male connector also has a rectangular aperture extending through both the ends and faces. The second end also has four male flanges extending generally radially with end faces being coplanar with the side faces of the first end. The flanges are coplanar with the inner face of the second end. Recesses are formed between the flanges and the first end of the male connector.

The flanges are angularly displaced from each other by 90 degrees. A plurality of bores are positioned in the corners of the first end of the male connector. Next provided is a female connector. The female connector has a generally rectangular configuration with an inner face, an outer face and a plurality of side faces. The female connector also has an annular recessed ring. Further, the female connector has a rectangular aperture extending through both faces of the female connector and aligning with the rectangular aperture of the male connector when in a locked state. The female connector includes four generally L-shaped female receivers. Each female receiver has a base being coplanar with its associated side face and a lip extending towards the rectangular aperture. The lip also has an arcuate edge shaped to match the circumference of the cylindrically extending portion of the male connector. The lip extends tangentially from the base forming a recess to accept the flanges of the male connector. The bases of the receivers are positioned 90 degrees from each other and are symmetrically located with respect to the central axis of the system. In this manner when in the locked state the flanges of the male connector form a coplanar coupling with the receivers of the female connectors. A plurality of bores are positioned in the corners of the female connector and aligning with the bores of the male connector when in the locked state. Provided next is an o-ring. The o-ring is provided to reside within the recessed ring of the female connector allowing for a snug fit when in the locked state. Last provided are a pair of elastomeric cables. The cables are in a rectangular configuration and coupled to the rectangular aperture of the male and female connectors. One cable forms a coplanar connection with the inner face of the female connector. The other cable is formed just short of the inner face of the male connector.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is, therefore, an object of the present invention to provide a new and improved waveguide interconnection system which has all of the advantages of the prior art connection systems and none of the disadvantages.

It is another object of the present invention to provide a new and improved waveguide interconnection system which may be easily and efficiently manufactured and marketed.

It is further object of the present invention to provide a new and improved waveguide interconnection system which is of durable and reliable constructions.

An even further object of the present invention is to provide a new and improved waveguide interconnection system which is susceptible of a low cost of manufacture with regard to both materials and labor, and which accordingly is then susceptible of low prices of sale, thereby making such waveguide interconnection system economically available.

Even still another object of the present invention is to provide a waveguide interconnection system for connecting and disconnecting components.

Lastly, it is an object of the present invention to provide an interconnection system for effecting the rapid connection and disconnection of facing components and which comprises male and female connectors. A first end of the male connector is generally rectangular. The second end has a cylindrical portion extending inwardly, an inner face, and radially extending flanges. Recesses are formed between the flanges and the first end. The female connector is configured for mating with the male connector. When in the locked state the flanges of the male connector form a coplanar coupling with receivers of the female connector.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective illustration of the new and improved waveguide interconnection system constructed in accordance with the principles of the present invention.

FIG. 2 is a cross-sectional view of the system taken along line 2—2 of FIG. 1.

FIG. 3 is an exploded side view of the system shown in FIGS. 1 and 2.

FIG. 4 is an exploded perspective view of the system shown in prior Figures.

The same reference numerals refer to the same parts throughout the various Figures.

DESCRIPTION OF THE PREFERRED EMBODIMENT

Figure 5:
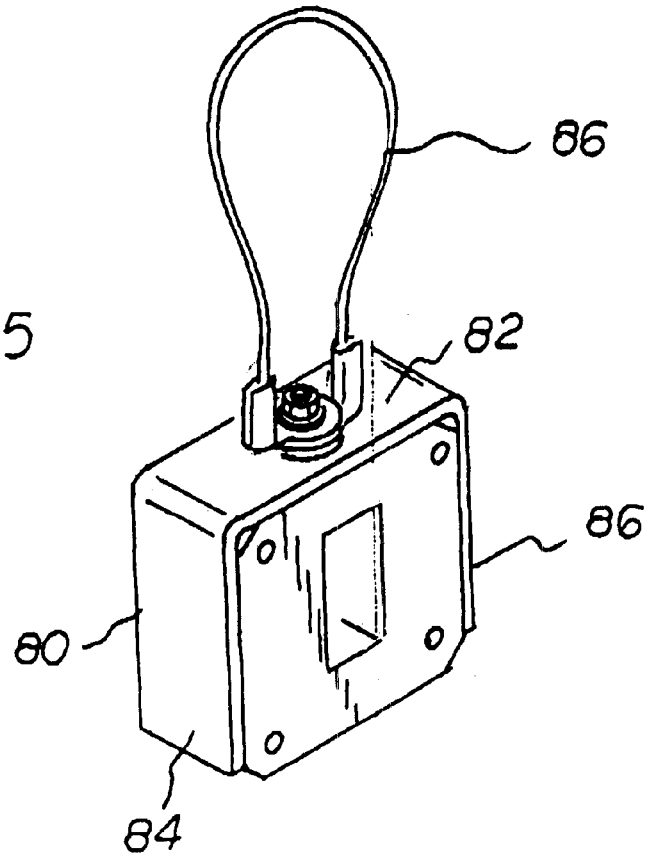
FIG. 5 is perspective view of a support device as a component of the present invention.
Figure 6:
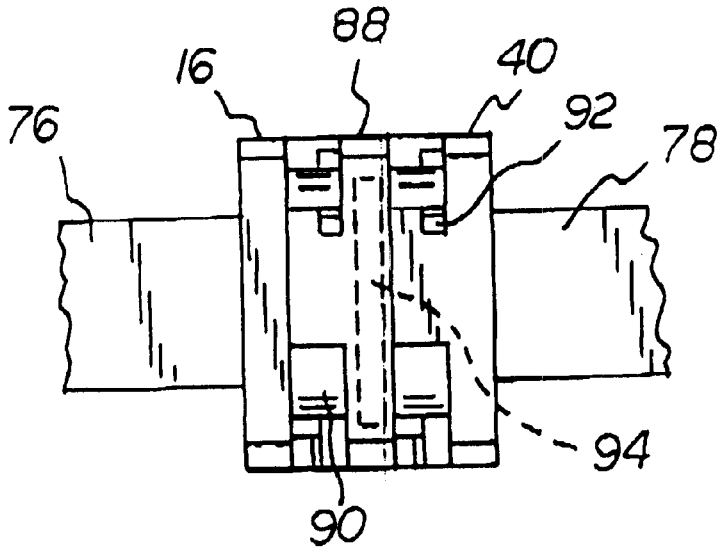
FIG. 6 is side view of the present invention with an intermediate portion supporting a filter.

With reference now to the drawings, and in particular to FIGS. 1–4 thereof, the preferred embodiment of the new and improved waveguide interconnection system embodying the principles and concepts of the present invention and generally designated by the reference numeral 10 will be described.

The present invention, the waveguide interconnection system 10 is comprised of a plurality of components. Such components in their broadest context include a male connector, a female connector, an o-ring and a pair of elastomeric cables. Such components are individually configured and correlated with respect to each other so as to attain the desired objectives.

First provided is a male connector 14. The male connector has a first end 16 of a generally rectangular configuration. The first end has an outer face 18 and a plurality of side faces 20. The male connector also has a second end 22. The second end comprises a cylindrically shaped portion 24 extending inwardly with respect to the system. The second end has an inner face 26. The male connector also has a rectangular aperture 28 extending through both the ends and faces.

The second end has four male flanges 30 extending generally radially with end faces 32 formed coplanar with the side faces of the first end. The flanges are coplanar with the inner face of the second end. Recesses 34 are formed between the flanges and the first end of the male connector. The flanges are angularly displaced from each other by 90 degrees. A plurality of bores 36 are positioned in the corners of the first end of the male connector.

Next provided is a female connector 40. The female connector has a generally rectangular configuration with an inner face 42, an outer face 44 and a plurality of side faces 46. The female connector also has an annular recessed ring 48. Further, the female connector has a rectangular aperture 50 extending through both faces of the female connector and aligning with the rectangular aperture of the male connector when in a locked state.

The female connector has four L-shaped female receivers 52. Each female receiver has a base 60 being coplanar with its associated side face and a lip 62 extending towards the rectangular aperture. The lip also has an arcuate edge 64 configured to match the circumference of the cylindrically extending portion of the male connector. The lips extend tangentially from the bases forming recesses to accept the flanges of the male connector. The bases of the receivers are positioned 90 degrees from each other and are symmetrically located with respect to the central axis of the system. In this manner, when in the locked state, the flanges of the male connector form a rectangular coplanar surface with the receivers of the female connectors. A plurality of bores 68 are positioned in the corners of the female connector and aligning with the bores of the male connector when in the locked state. This allows for the use of threaded fasteners to extend through the aligned bores of the male and female fasteners for thereby achieving a more secure coupling.

Provided next is an o-ring 72. The o-ring is provided to reside within the ring of the female connector allowing for a snug fit when in the locked state.

Also provided are a pair of elastomeric cables 76, 78. The cables are in a rectangular configuration and coupled to the rectangular aperture of the male and female connectors. One cable forms a coplanar connection with the inner face of the female connector. The other cable is formed just short of the inner face of the male connector. The cables are formed with central rectangular apertures there through aligned with the apertures of the connectors for the passage of microwave transmissions. The cables are formed of an elastomeric material, plastic or rubber, natural or synthetic, or blends thereof. The cables are resilient so that they will return to their original shapes, normally linear, after a deforming force has been removes. The cables are also flexible so they may be deformed as when coupling or uncoupling the male and female connectors.

The system preferably includes a U-shaped support mechanism 80. This U-shaped support mechanism has a top face 82 and a pair of parallel side faces 84 and is adapted to slide over the system when in the locked state. When covering the system the support mechanism faces come into contact with three faces of the system. Additionally, the top face has a hoop 86 attached thereto for being grasped during the removal and application of the support mechanism.

The system may further include an intermediate portion 88. This intermediate portion has a female connector 90 adapted to couple with the male connector of the system. The intermediate portion also has a male connector 92 adapted to couple with the female connector of the system. The central region of the intermediate portion is adapted to support a filter 94 in the path of travel of microwave transmissions through the cables. The filter functions to modify the transmitted microwaves.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A waveguide interconnection system for effecting the rapid connection and disconnection of facing components comprising, in combination;

a male connector having a first end of a generally rectangular configuration with an outer face and a plurality of side faces, the male connector also having a second end comprising a cylindrical portion extending inwardly with respect to the system with an inner face, the male connector further having a rectangular aperture extending through both the ends and faces, the second end having four male flanges extending radially with end faces being coplanar with the side faces of the first end, the flanges are coplanar with the inner face of the second end, with recesses formed between the flanges and the first end of the male connector, the flanges also being angularly displaced from each other by 90 degrees, a plurality of bores positioned in the corners of the first end of the male connector;

a female connector having a generally rectangular configuration with an inner face, an outer face and a plurality of side faces, the female connector also has an annular recessed ring, the female connector further having a rectangular aperture extending through both faces of the female connector and aligning with the rectangular aperture of the male connector when in a locked state, the female connector having four L-shaped female receivers each with a base being coplanar with its associated side face and a lip extending horizontally towards the rectangular aperture, the lip also having an arcuate edge configured to match the circumference of the cylindrically extending portion of the male connector, the lip further extending tangentially from the base forming a recess to accept the flanges of the male connector, the bases of the receivers being positioned 90 degrees from each other and symmetrically located with respect to the central axis of the system, such that when in the locked state the flanges of the male connector form a coplanar coupling with the receivers of the female connectors, a plurality of bores being positioned in the corners of the female connector and aligning with the bores of the male connector when in the locked state;

an o-ring being provided to reside within the recessed ring of the female connector allowing for a snug fit when in the locked state; and a pair of elastomeric cables with a rectangular configuration being coupled to the rectangular aperture of the male and female connectors, the cable forming a coplanar connection with the inner face of the female connector and the cable being formed just short of the inner face of the male connector.

2. An interconnection system for effecting the rapid connection and disconnection of facing components comprising male and female connectors, a first end of the male connector being generally rectangular, the second end having a cylindrically extending portion pointing inward, an inner face, and generally radially extending flanges, recesses formed between the flanges and the first end, the female connector being configured to mate with the male connector when in the locked state the flanges of the male connector forming a coplanar coupling with receivers of the female connector; and a U-shaped support mechanism having a top face and a pair of parallel side faces adapted to slide over the system when in the locked state such that the support mechanism faces come in contact with three faces of the system, the top face having a hoop attached thereto for assisting a user in the removal and application of the support mechanism.

3. An interconnection system for effecting the rapid connection and disconnection of facing components comprising male and female connectors, a first end of the male connector being generally rectangular, the second end having a cylindrically extending portion pointing inward, an inner face, and generally radially extending flanges, recesses formed between the flanges and the first end, the female connector being configured to mate with the male connector when in the locked state the flanges of the male connector forming a coplanar coupling with receivers of the female connector; and an intermediate portion, the intermediate portion having a female connector adapted to couple with the male connector of the system and a male connector to couple with the female connector of the system and a filter within the intermediate portion.

* * * * *